US007003958B2

(12) United States Patent
Dinu et al.

(10) Patent No.: US 7,003,958 B2
(45) Date of Patent: Feb. 28, 2006

(54) MULTI-SIDED DIFFUSER FOR A VENTURI IN A FUEL INJECTOR FOR A GAS TURBINE

(75) Inventors: Constantin Alexandru Dinu, Greer, SC (US); Iris Ziqin Hu, Greer, SC (US); James Michael Storey, Taylors, SC (US)

(73) Assignee: General Electric Company, Schenectady, NY (US)

( * ) Notice: Subject to any disclaimer, the term of this patent is extended or adjusted under 35 U.S.C. 154(b) by 115 days.

(21) Appl. No.: 10/879,102

(22) Filed: Jun. 30, 2004

(65) Prior Publication Data

US 2006/0000218 A1 Jan. 5, 2006

(51) Int. Cl.
*F02C 1/00* (2006.01)
*F02G 3/00* (2006.01)

(52) U.S. Cl. ..... 60/737; 60/723; 60/39.822

(58) Field of Classification Search ..... 60/737, 60/723, 740, 742, 747, 39.822
See application file for complete search history.

(56) References Cited

U.S. PATENT DOCUMENTS 3,143,401 A * 8/1964 Lambrecht ..... 48/180.1
3,643,431 A * 2/1972 Jamieson ..... 60/738
4,226,087 A * 10/1980 Spadaccini ..... 60/749
4,356,698 A * 11/1982 Chamberlain ..... 60/733
4,845,952 A 7/1989 Beebe
4,966,001 A 10/1990 Beebe
5,161,366 A * 11/1992 Beebe ..... 60/777
5,826,429 A * 10/1998 Beebe et al. ..... 60/723
5,850,731 A * 12/1998 Beebe et al. ..... 60/778
5,924,276 A * 7/1999 Mowill ..... 60/39.23
6,220,034 B1 * 4/2001 Mowill ..... 60/737
6,250,066 B1 * 6/2001 Lawrence et al. ..... 60/39.23
6,442,939 B1 * 9/2002 Stuttaford et al. ..... 60/737
6,460,345 B1 * 10/2002 Beebe et al. ..... 60/777
6,886,341 B1 * 5/2005 Inoue et al. ..... 60/737

* cited by examiner

*Primary Examiner*—William H. Rodriguez
(74) *Attorney, Agent, or Firm*—Nixon & Vanderhye P.C.

(57) ABSTRACT

A combustor for a gas turbine includes a main fuel injector for receiving compressor discharge air and mixing the air with fuel for flow to a downstream catalytic section. The main fuel injector includes an array of venturis each having an inlet, a throat and a diffuser. A main fuel supply plenum between forward and aft plates supplies fuel to secondary annular plenums having openings for supplying fuel into the inlets of the venturis upstream of the throats. Each diffuser transitions from a circular cross-section at the throat to multiple discrete angularly related side walls at the diffuser exit. Gaps between circumferentially and radially spaced diffusers at their exits are eliminated. With this arrangement, uniform flow distribution of the fuel/air, velocity and temperature is provided at the catalyst inlet.

19 Claims, 6 Drawing Sheets

MULTI-SIDED DIFFUSER FOR A VENTURI IN A FUEL INJECTOR FOR A GAS TURBINE

BACKGROUND OF THE INVENTION

The present invention relates to a venturi configuration forming part of the main fuel injector in a combustor for a gas turbine and particularly relates to a venturi diffuser configuration affording a uniformity of the fuel/air mixture downstream of the fuel injector and at the catalyst inlet.

In certain fuel gas injectors for combustors in a gas turbine, there are provided a plurality of closely spaced parallel venturi tubes disposed in a pair of spaced apart header plates. The header plates and the venturi tubes form a plenum into which pressurized fuel is supplied and from which fuel is supplied through orifices into the venturi tubes to the interior of the tubes for mixing with high velocity air streams passing through the venturi tubes. In prior fuel injection systems of this type, for example, see U.S. Pat. Nos. 4,845,952 and 4,966,001, the combined flow from the venturi tubes mixes downstream prior to entry into the catalyst inlet plane. The prior venturi tubes are generally of circular cross-sectional configurations and have substantial gaps at the exit plane of the diffusers between the circular diffuser exits. While the fuel/air mixing occurs within the venturis and the venturis complete the combustor cross-section, mixing also occurs in the downstream region between the venturi exit plane and the catalyst inlet. Because of the large recirculation regions that form in the wake of the inter-venturi gaps, it has been found that the flame holding resistance has diminished. Accordingly, there is a need for improved fuel/air mixing, particularly downstream of the venturi tubes, to insure a uniformity of the fuel/air mixture across the entire cross-section of the catalyst inlet.

BRIEF DESCRIPTION OF THE INVENTION

In accordance with the preferred aspect of the present invention, there is provided a shaped diffuser for the venturi tubes of a main fuel injector of a combustor for a gas turbine which affords a uniform fuel/air mixture across the cross-section of the combustor at the catalyst inlet. The venturis are arranged in concentric circular rows about the axis of the combustor. Each diffuser is multi-sided and includes two sides spaced radially one from the other and a pair of circumferentially adjacent sides along spaced radii. The respective adjacent sides form common sides between circumferentially and radially adjacent diffusers.

The diffuser outlets thus entirely eliminate gaps between the circular diffuser outlets of prior venturis. Consequently, the large recirculation regions that previously formed downstream of the venturi exits using venturis having circular diffuser cross-sections are entirely eliminated and the risk for flame-holding is greatly reduced.

In a preferred aspect of the present invention, there is provided a combustor for a turbine, a fuel injector comprising a venturi including a convergent inlet, a throat and a diffuser for flowing a fuel/air mixture, the venturi body including a fuel supply hole for flowing fuel into the venturi, the diffuser having multiple discrete angularly related side walls terminating at an outlet remote from the throat.

In another aspect of the present invention, there is provided a combustor for a gas turbine, a fuel injector comprising an array of venturis about a combustor axis, each venturi including a converging inlet, a throat and a diffuser for flowing the fuel/air mixture, each venturi including a fuel supply hole for flowing fuel into the venturi, each diffuser having multiple discrete angularly related side walls therealong, the array of venturis being arranged in circumferential side-by-side relation to one another about the axis.

DETAILED DESCRIPTION OF THE INVENTION

Figure 1:
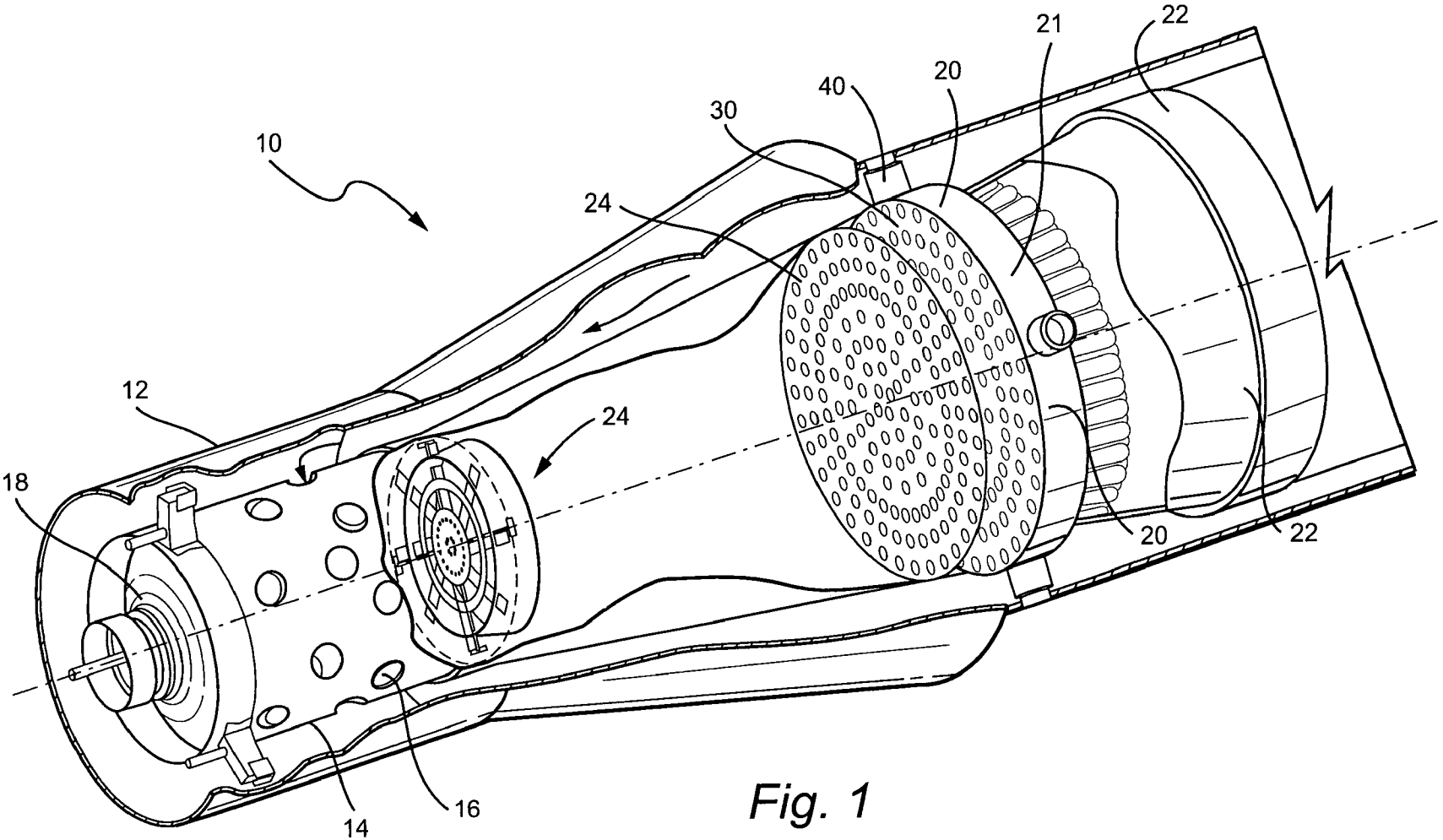
FIG. 1 is a fragmentary perspective view with parts broken out and in cross section illustrating a portion of a catalytic combustor for use in a gas turbine incorporating a multi-venturi tube arrangement according to a preferred aspect of the present invention.

As will be appreciated a typical gas turbine has an array of circumferentially spaced combustors about the axis of the turbine for burning a fuel/air mixture and flowing the products of combustion through a transition piece for flow along the hot gas path of the turbine stages whereby the energetic flow is converted to mechanical energy to rotate the turbine rotor. The compressor for the turbine supplies part of its compressed air to each of the combustors for mixing with the fuel. A portion of one of the combustors for the turbine is illustrated in FIG. 1 and it will be appreciated that the remaining combustors for the turbine are similarly configured. Smaller gas turbines can be configured with only one combustor having the configuration illustrated in FIG. 1.

Referring to FIG. 1 a combustor, generally designated 10, includes a preburner section 12 having an interior flow liner 14. Liner 14 has a plurality of holes 16 for receiving compressor discharge air for flow in the preburner section 12. Preburner section 12 also includes a preburner fuel nozzle 18 for supplying fuel to the preburner section. The flow of combustion products, from the preburner section has a center peaked flow distribution, i.e., both flow velocity and temperature, which does not result in the desired uniform flow to the additional fuel injectors, e.g., the venturi fuel type injectors described and illustrated in U.S. Pat. No. 4,845,952. The main fuel injector is designated 20 in FIG. 1 and forms part of a multi-venturi tube arrangement of which certain aspects are in accordance with a preferred embodiment of the present invention. The air and products of combustion from the preburner section 12 and the fuel from the fuel injector 20 flow to a catalyst or catalytic section 22. As a consequence there is a lack of uniformity of the flow at the inlet to the catalytic section 22. One effort to provide such uniformity, has resulted in the design of a flow controller generally designated 24 between the preburner section 12 and the fuel injector 20. Details of the flow conditioner 24 may be found in U.S. patent application Ser. No. 10/648,203 filed Aug. 27, 2003 for Flow Controller For Gas Turbine Combustors, the subject matter of which is incorporated herein by reference.

At the inlet to the multi-venturi tube arrangement 21 (hereinafter MVT) forming part of the main fuel injector 20, there is provided a perforated plate 24 to assist in conditioning the flow of fuel/air to obtain optimum mixing and uniform distribution of the flows and temperature at the inlet to catalytic section 22.

Figure 2:
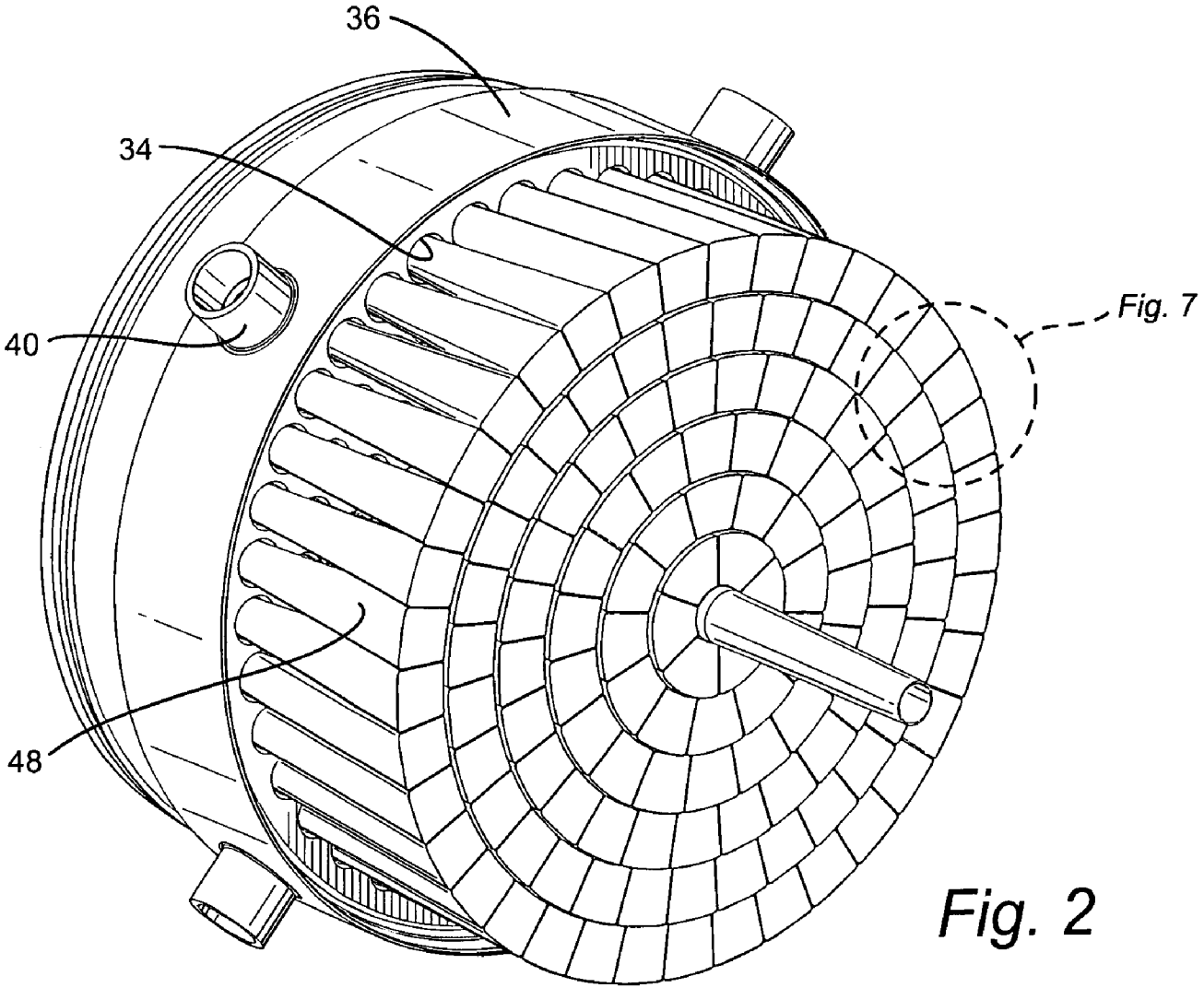
FIG. 2 is a perspective view of the multi-venturi tube arrangement.
Figure 3:
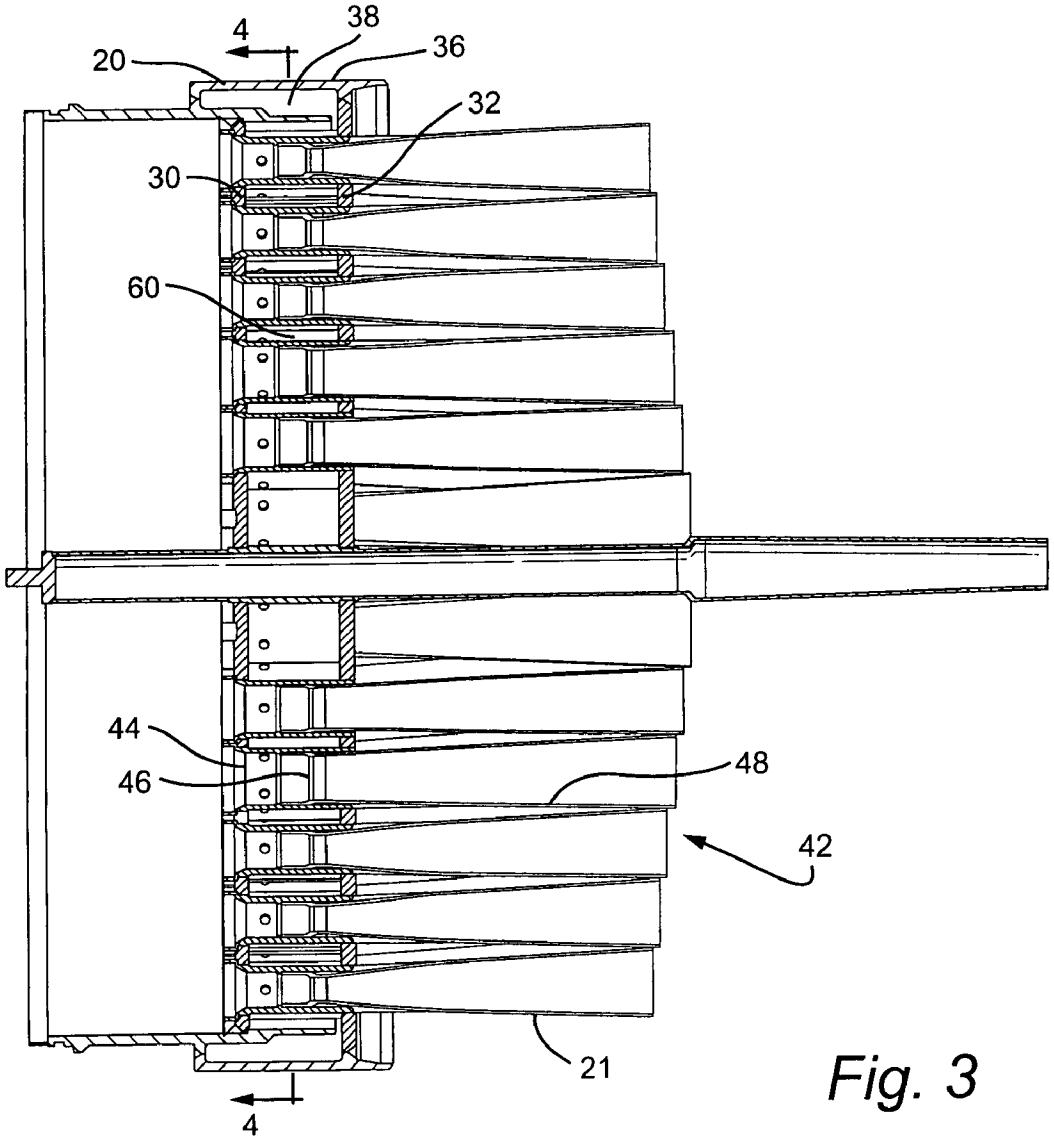
FIG. 3 is a cross-sectional view thereof.
Figure 4:
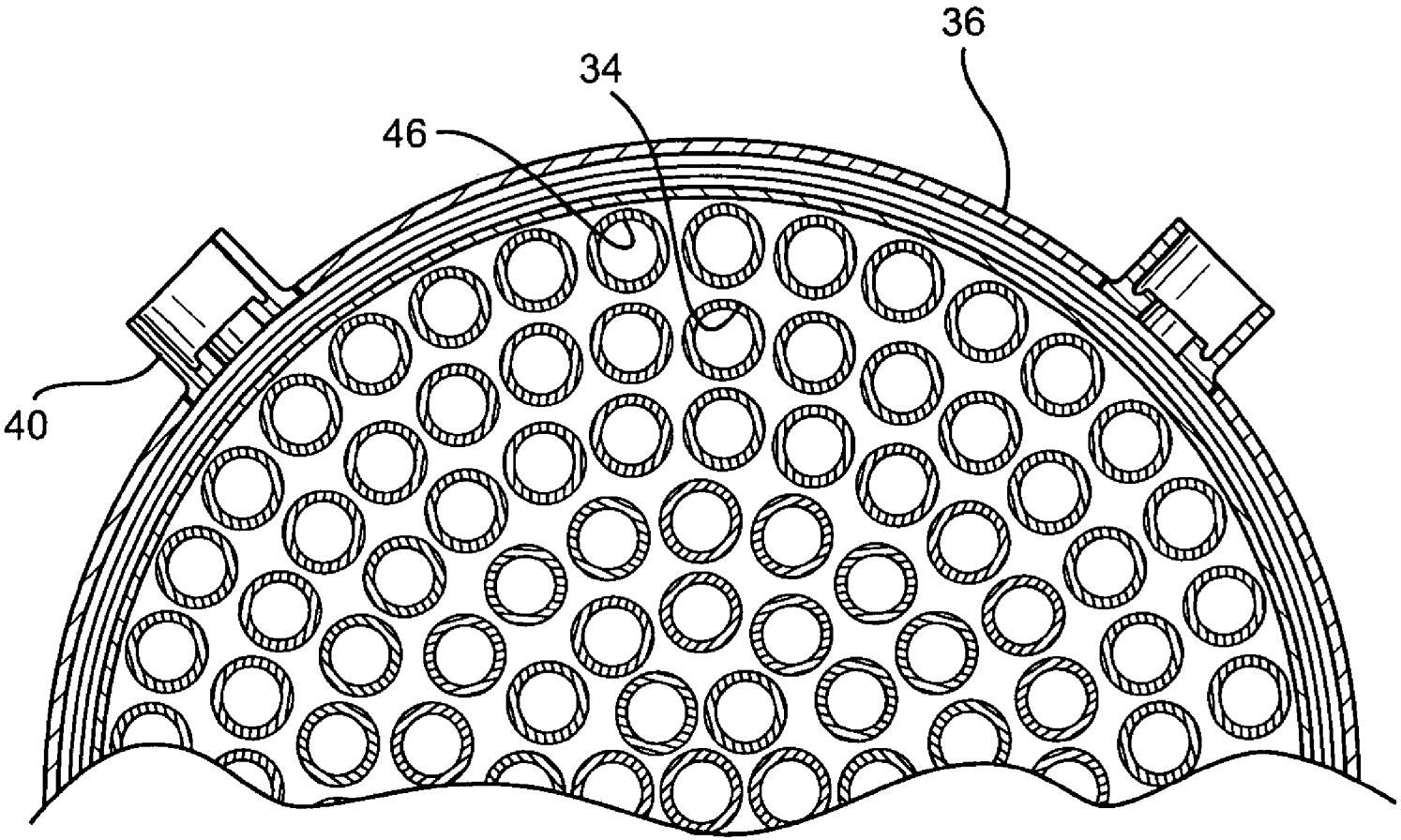
FIG. 4 is a cross-sectional view thereof taken generally about on line 4—4 in FIG. 3.
Figure 5:
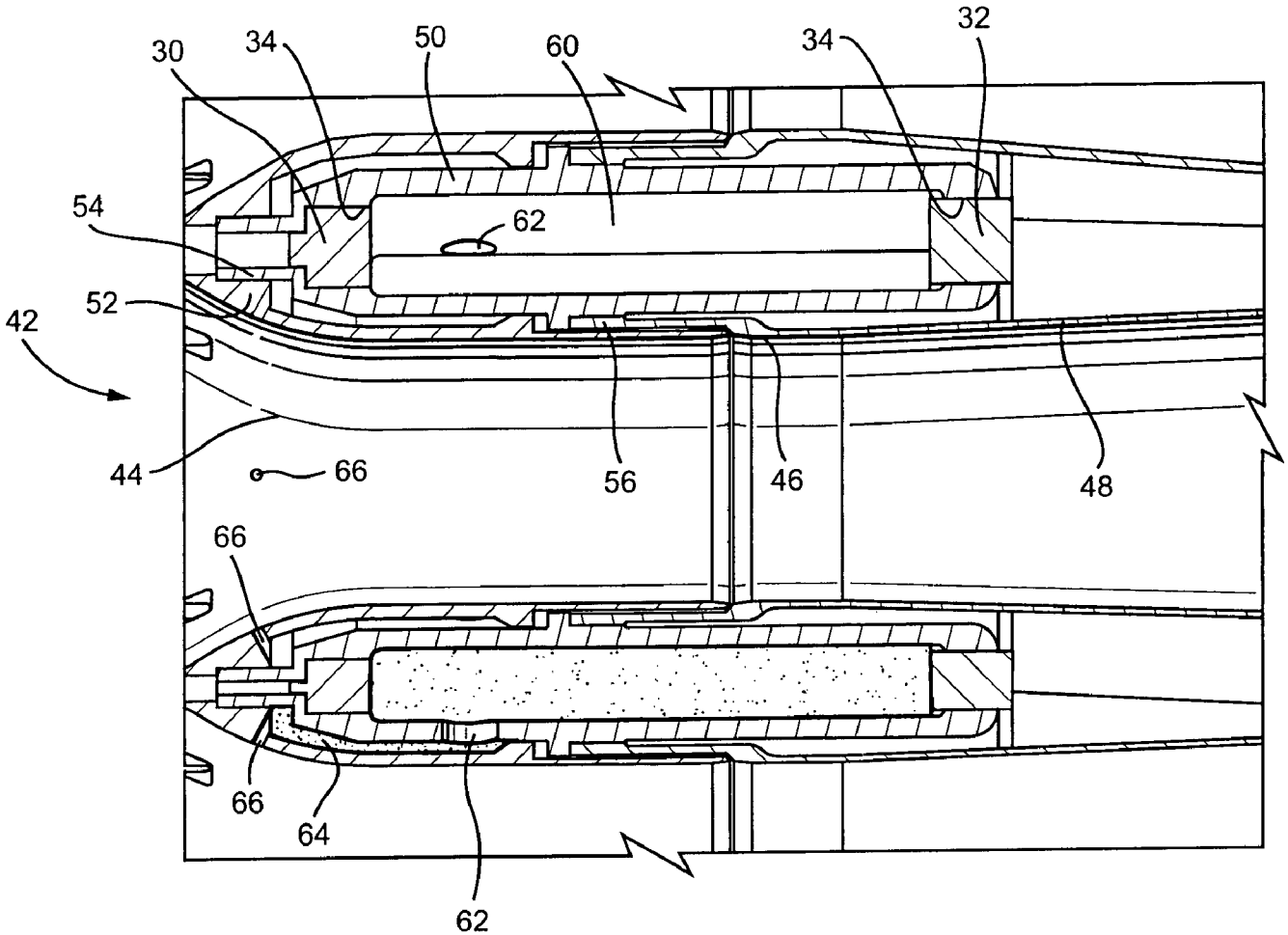
FIG. 5 is an enlarged fragmentary view with parts in cross-section illustrating a venturi and the fuel plenums.

The main fuel injector 20 includes a pair of axially spaced perforated plates, i.e. a front plate 30 and an aft plate 32 (FIGS. 1, 3 and 5). Plates 30 and 32 are perforated and form axially aligned annular arrays of openings, e.g., openings 34 in FIG. 4 of plate 30. A casing 36 defining a plenum 38 surrounds and is secured to the outer margins of the front and aft plates 30 and 32 respectively. As illustrated in FIGS. 2 and 4, a plurality of fuel inlets 40, four being shown, are equally spaced about the periphery of the casing 36 for supplying fuel to the plenum 38.

The openings through the plates 30 and 32 are closed by venturis generally designated 42 and forming part of the MVT 21. Thus each pair of axially aligned openings 34 through the plates 30 and 32 receive a venturi 42. Each venturi includes a converging inlet section 44, a throat 46 and a diverging section or diffuser 48. Each venturi is a three part construction; a first part including the inlet converging portion 44, a second part comprising the throat and diffuser 46 and 48, and a third part comprising an annular venturi member or body 50. Body 50 extends between each of the axially aligned openings in the front and aft plates 30 and 32 and is secured thereto for example by brazing. The converging inlet section 44 of the venturi 42 includes an inlet flange 52 which is screw threaded to a projection 54 of the body 50. The integral throat and diffuser 46 and 48, respectively, has an enlarged diameter 56 at its forward end which surrounds the aft end of the inlet 44 and is secured, preferably brazed, thereto.

It will be appreciated that the space between the front and aft plates 30 and 32 and about the annular bodies 50 of each venturi constitutes a main fuel plenum 60 which lies in communication with the fuel inlets 40. The main fuel plenum 60 lies in communication with each inlet section 44 via an aperture 62 through the annular body 50, a mini fuel plenum 64 formed between the body 50 and the inlet 44 and supply holes 66 formed adjacent the leading edge of the inlet section 44. The fuel supply holes 66 are spaced circumferentially one from the other about the inlet 44 and preferably are four in number. It will be appreciated that the fuel inlet holes 66 to the venturi are located upstream of the throat 46 and in the converging section of the inlet section 44. Significantly improved mixing of the fuel/air is achieved by locating the fuel injection holes 66 in the converging inlet section of the venturi without flow separation or deleterious flame holding events.

Fuel from the fuel inlet plenum 38 circulates between the front and aft plates 30 and 32 and about the annular bodies 50 for flow into the venturis 42 via the fuel apertures 62, the mini plenums 64 between the inlet sections 44 and annular bodies 50 and the fuel inlet holes 66. With the fuel inlet holes located adjacent the inlets to the converging sections of the venturis, the fuel is injected in a region where the air side pressure is higher, e.g., compared to static pressure at the throat. It will be appreciated that the magnitude of the fuel/air mixing taking place in each venturi is directly related to the jet penetration which in turn depends on the pressure ratio across the fuel injection holes 66 and the jet momentum ratio, i.e., between the jets and the main flow stream. To increase the pressure ratio and decouple the fuel injection from airflow distribution, the fuel holes are located upstream of the throat. The fuel is therefore injected in a region where the air-side pressure is higher compared to the static pressure at the throat and therefore, for the same fuel side effective area, the pressure ratio is increased. An optimum pressure ratio-circumferential coverage is achieved. Air velocity is also lower than at the throat and therefore the jets of fuel adjacent the venturi inlet sections 44 develop under better conditions from a momentum ratio standpoint. Further, improved air fuel mixing due to this fuel inlet location is achieved also by the increased mixing length, i.e., the actual travel distance inside the venturi for the same overall length of tube. Additionally, the venturis 42 are fixed between the two plates 30 and 32 to form the main fuel plenum 60 between the plates and the outside surfaces of the venturis. Fuel is introduced into plenum 60 from the outside diameter. A general flow of fuel with some axial symmetry occurs from the outside diameter of the plenum toward the center of the MVT as the venturis are fed with fuel. Thus, a potential imbalance in fuel flow around the tubes and among the tubes with a penalty in mixing performance which occurs with fuel injection at the venturi throats is avoided since the fuel injection holes into the venturis are spatially displaced from a plane in which the general plenum flow occurs. Finally, because the fuel inlet injection holes 66 are located adjacent the venturi inlet section 44, the potential for fuel jet induced flow separation inside the venturis is greatly reduced.

Figure 7:
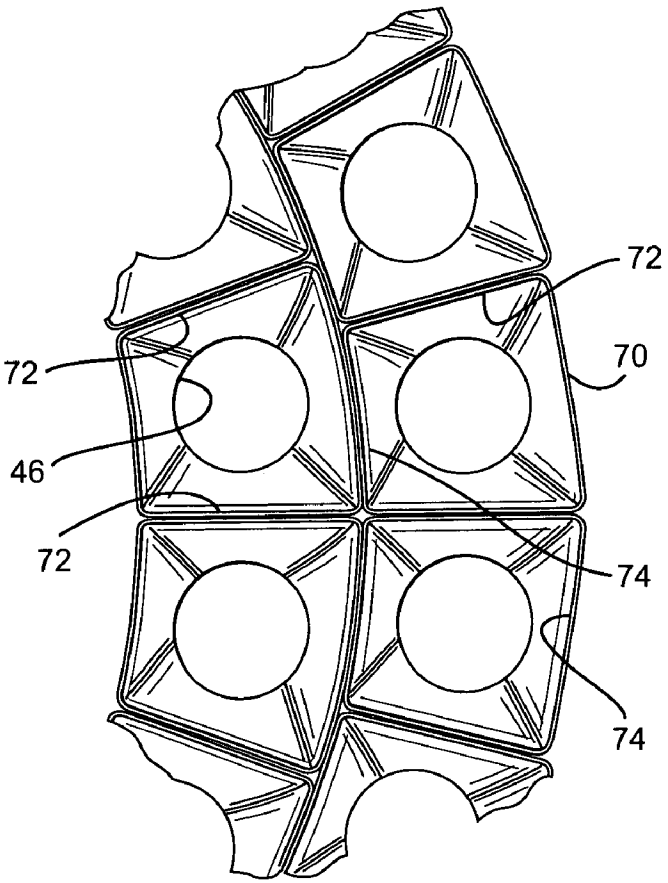
FIG. 7 is an enlarged fragmentary end view of the diverging sections of the multi-venturi tubes as viewed in an upstream direction.
Figure 6:
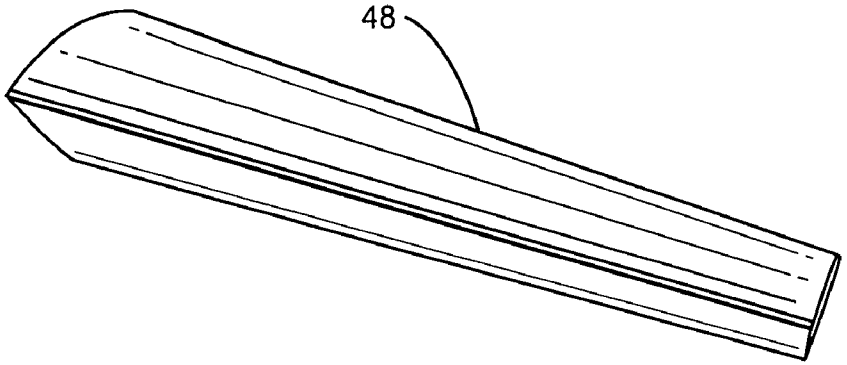
FIG. 6 is a fragmentary perspective view of a portion of the diverging tube of the venturi.

Referring now to FIGS. 2, 6 and 7, each diffuser 48 transitions from a circular shape at the throat 46 to a generally frustum shape at the exit. That is, the diffuser 48 transitions from a circular shape at the throat into multiple discrete angularly related sides 70 (FIG. 7). Sides 70 terminate in circumferentially spaced radially extending side walls 72 as well as radially spaced circumferentially extending arcuate side walls 74 opposite one another. As illustrated, the diffusers 48 are arranged in circular patterns to achieve an axisymmetric geometry by transitioning from circular throat areas to generally frustum areas at their exits. Any gaps between the adjacent venturis both in a radial and circumferential directions are substantially eliminated as can be seen in FIGS. 2 and 7. Thus, as illustrated in FIG. 7, the radial extending walls 72 of each diffuser at each venturi exit lie in contact with and are secured to the corresponding wall 72 of the circumferentially adjacent diffusers. Similarly, the arcuate walls 74 of each diffuser exit lie in contact with adjacent walls 74 of the next radially adjacent diffuser exit. Also, the venturis are arranged in a pattern of circular arrays at different radii about the axis. Thus, gaps between the radially and circumferentially adjacent diffuser exit walls are minimized or eliminated at the exit plane. Previously, for example, as illustrated in U.S. Pat. No. 4,845,952, the exit plane of the venturi diffusers had large gaps between the circular exits. Those interventuri gaps produced large recirculation regions downstream of the exit plane which are filled in by the exit flow from the circular venturis. By transitioning from the circular cross-section at the throat of the venturis to generally frustums at the exit plane of the venturis with minimized or eliminated gaps between circumferentially and radially adjacent venturi exits, these prior large recirculation regions formed downstream of the venturi exits and the risk for flame holding are greatly reduced or eliminated. It will also be appreciated that by providing each venturi in a multi part construction, i.e., an inlet 44 and a combined throat and diffuser section 46, 48, the inlet 44 can be removed for tuning, refurbishing or testing flexibility purposes.

Further, from a review of FIG. 3, the venturi exits are stepped towards the outside diameter and in an upstream direction. That is, the venturi exits are spaced axially increasing distances from a plane normal to the flow through the combustor in a radial outward upstream direction. This enables any gap between adjacent venturis to be further reduced. Also, by making the radial outer venturis shorter, the angle of the exit diffuser is reduced, e.g. to about 7.8° thereby reducing the potential for flow separation in the exit diffuser.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a combustor for a turbine, a fuel injector comprising a venturi including a convergent inlet, a throat and a diffuser for flowing a fuel/air mixture, said venturi including a fuel supply hole for flowing fuel into the venturi, said diffuser having multiple discrete angularly related side walls terminating at an outlet remote from said throat, said side walls of said diffuser including two opposed, radially spaced, arcuate wall surfaces.

2. A venturi according to claim 1 wherein said throat has a circular cross-section and said diffuser transitions smoothly from said throat to said outlet.

3. A venturi according to claim 1 wherein said venturi is formed of at least two discrete parts joined axially to one another.

4. A venturi according to claim 3 wherein one of said parts includes said convergent inlet, said throat and said diffuser being integral with one another and forming another of said parts thereof, said parts being joined one to the other at said throat.

5. In a combustor for a turbine, a fuel injector comprising a venturi including a convergent inlet, a throat and a diffuser for flowing a fuel/air mixture, said venturi including a fuel supply hole for flowing fuel into the venturi, said diffuser having multiple discrete angularly related side walls terminating at an outlet remote from said throat, said side walls of said diffuser including a pair of linearly extending, circumferentially spaced, side wall surfaces.

6. A venturi according to claim 5 wherein said side walls of said diffuser include two opposed, radially spaced, arcuate wall surfaces.

7. A venturi according to claim 5 wherein said throat has a circular cross-section and said diffuser transitions smoothly from said throat to said outlet.

8. A venturi according to claim 5 wherein said venturi is formed of at least two discrete parts joined axially to one another.

9. A venturi according to claim 8 wherein one of said parts includes said convergent inlet, said throat and said diffuser being integral with one another and forming another of said parts thereof, said parts being joined one to the other at said throat.

10. In a combustor for a gas turbine, a fuel injector comprising an array of venturis about a combustor axis, each said venturi including a converging inlet, a throat and a diffuser for flowing the fuel/air mixture, each said venturi including a fuel supply hole for flowing fuel into the venturi, each said diffuser having multiple discrete angularly related side walls therealong, said array of venturis being arranged in circumferential side-by-side relation to one another about said axis.

11. An injector according to claim 10 wherein circumferentially adjacent diffusers have adjoining radially extending side walls.

12. An injector according to claim 11 wherein said adjoining side walls extend linearly along radii of said axis.

13. An injector according to claim 10 wherein said array of venturis are arranged in multiple circular arrays thereof at different radii relative to said axis, radially adjacent diffusers of said venturi bodies having arcuate adjoining side walls.

14. An injector according to claim 13 wherein said venturis are disposed in generally concentric rows about said axis.

15. An injector according to claim 14 wherein circumferentially adjacent diffusers of said venturi bodies have adjoining radially extending side walls.

16. An injector according to claim 10 wherein each of said venturi diffusers has a circular throat and transitional surfaces between said circular throat and said multiple discrete angularly related side walls at a diffuser exit.

17. An injector according to claim 10 wherein said venturis are disposed in generally concentric rows about said axis, said throats of said venturis lying in a common plane normal to said axis, said venturis terminating in said multiple angularly related side walls in exit openings staggered in an axial direction with radially innermost venturis having exit openings spaced from corresponding throats thereof distances greater than distances radially outermost exit openings are spaced from corresponding throats thereof.

18. An injector according to claim 17 wherein said diffuser exit openings are staggered in an axial upstream direction and in a radial outward direction.

19. An injector according to claim 10 wherein said array of venturis are arranged in multiple circular arrays thereof at different radii relative to said axis, said side walls of each venturi terminating in a frustum at an outlet thereof remote from said throat.

* * * * *